US012352288B2

(12) United States Patent
Baillargeon et al.

(10) Patent No.: US 12,352,288 B2
(45) Date of Patent: Jul. 8, 2025

(54) DOWNHOLE CENTRIFUGAL PUMPS INCLUDING LOCKING FEATURES AND RELATED COMPONENTS AND METHODS

(71) Applicant: CHAMPIONX LLC, Sugar Land, TX (US)

(72) Inventors: David Baillargeon, Broken Arrow, OK (US); Scott Asmussen, Broken Arrow, OK (US); Michael Rumbaugh, Broken Arrow, OK (US)

(73) Assignee: CHAMPIONX LLC, Sugar Land, TX (US)

( * ) Notice: Subject to any disclaimer, the term of this patent is extended or adjusted under 35 U.S.C. 154(b) by 19 days.

(21) Appl. No.: 18/095,490

(22) Filed: Jan. 10, 2023

(65) Prior Publication Data

US 2024/0229827 A1 Jul. 11, 2024

(51) Int. Cl.

| | |
|---|---|
| ***F04D 29/62*** | (2006.01) |
| ***E21B 4/00*** | (2006.01) |
| ***E21B 17/10*** | (2006.01) |
| ***E21B 43/12*** | (2006.01) |
| ***F04D 17/16*** | (2006.01) |
| ***F04D 29/046*** | (2006.01) |
| ***F04D 29/44*** | (2006.01) |

(52) U.S. Cl.

CPC ..... *F04D 29/628* (2013.01); *E21B 4/003* (2013.01); *E21B 17/1057* (2013.01); *E21B 43/128* (2013.01); *F04D 17/16* (2013.01); *F04D 29/046* (2013.01); *F04D 29/445* (2013.01)

(58) Field of Classification Search

CPC ..... F04D 29/628; F04D 17/16; F04D 29/046; F04D 29/445; E21B 4/003; E21B 17/1057; E21B 43/128

See application file for complete search history.

(56) References Cited

U.S. PATENT DOCUMENTS

| | | | | |
|---|---|---|---|---|
| 9,677,560 | B1 * | 6/2017 | Davis | F04D 29/605 |
| 10,145,380 | B1 * | 12/2018 | Davis | F04D 29/041 |
| 2003/0215059 | A1 * | 11/2003 | Higgins | H01J 35/26 378/132 |
| 2015/0023815 | A1 * | 1/2015 | Tetzlaff | F04D 1/04 417/365 |
| 2015/0071799 | A1 * | 3/2015 | Johnson | F04D 29/0413 417/423.3 |
| 2017/0002823 | A1 * | 1/2017 | Gahlot | F04D 29/061 |
| 2017/0058616 | A1 * | 3/2017 | Lunk | E21B 43/128 |
| 2017/0159668 | A1 * | 6/2017 | Nowitzki | F16C 35/02 |
| 2021/0048029 | A1 * | 2/2021 | Ye | F04D 29/0473 |
| 2021/0140436 | A1 * | 5/2021 | Ye | F04D 29/044 |

OTHER PUBLICATIONS

How to Select the Proper Pin for Your Application, by Christie Jones, Copyright 2020 (Year: 2020).*

* cited by examiner

*Primary Examiner* — Brian Christopher Delrue
(74) *Attorney, Agent, or Firm* — BKRIP LLC

(57) ABSTRACT

Downhole centrifugal pumps and related components and methods may include diffusers housing impellers and a rotational shaft passing through the impellers to impart rotation to the impellers. Bearings are positioned within at least some of the diffusers to support the rotational shaft during the rotation of the impellers. Coupling pins may be positioned between and engage with the bearings and the at least some of the diffusers to at least partially secure each of the bearings to one of the at least some of the diffusers.

20 Claims, 5 Drawing Sheets

DOWNHOLE CENTRIFUGAL PUMPS INCLUDING LOCKING FEATURES AND RELATED COMPONENTS AND METHODS

TECHNICAL FIELD

The present disclosure generally relates to pumps and, in particular, to pump diffusers of a downhole centrifugal pump including one or more locking features for at least partially resisting rotational movement of components of the diffusers relative to another component of the pump during the operation of a downhole centrifugal pump system.

BACKGROUND

Submersible pumps are generally used to provide "artificial lift" or artificial methods that increase upward fluid flow from downhole sources, such as production wells. In most instances, submersible pumps include a motor portion that drives a shaft coupled to impellers which are in turn rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacent upper impeller, repeats until the fluid travels from the downhole source to an upper destination.

Impellers are designed to accelerate fluid flow upwardly as the fluid is input into the pump from a fluid inlet. Diffusers are built to direct fluid flow to an adjacent upper impeller. Specifically, diffusers generally have vanes that direct the fluid flow and build fluid pressure when transferring fluid to the adjacent upper impeller. The vanes of a diffuser include a lower pressure surface that receives fluid from an adjacently lower impeller and a higher pressure surface that directs the fluid to the adjacently upper impeller. After being moved through the impellers and diffusers of the pump, the fluid exits the pump, for example, to an uphole component in a downhole string.

During the rotation the impellers and the artificial lifting of the fluid through the pump, the components of the pump may be subjected to internal and/or external forces (e.g., rotational forces) that may impact operation of the pump. For example, such forces may act to loosen and/or fail couplings and/or orientations between components of the pump. Accordingly, such forces may impact the efficiency of the pump and/or may cause operational failure of the pump.

SUMMARY

Some embodiments of the instant disclosure may relate to a downhole centrifugal pump including: impellers; a rotational shaft passing through the impellers to impart rotation to the impellers; diffusers having a body housing the impellers; bearings positioned within at least some of the diffusers, the bearings being positioned within a central portion of the body of each of the at least some of the diffusers with the rotational shaft extending through each of the bearings to support the rotational shaft during the rotation of the impellers; coupling pins positioned between and engaged with the bearings and the at least some of the diffusers, the coupling pins configured to at least partially secure each of the bearings to one of the at least some of the diffusers against a rotational force applied to the bearings from the rotation of the rotational shaft; and bushings positioned adjacent to the bearings, the bushings each configured to secure one of the bearings along the rotational shaft in the central portion of the body of the at least some of the diffusers.

Some embodiments of the instant disclosure may relate to a centrifugal pump including: impellers; a rotational shaft passing through the impellers to impart rotation to the impellers; diffusers having a body housing the impellers; bearings positioned within the diffusers to support the rotational shaft extending through each of the bearings during the rotation of the impellers; and coupling pins positioned between and engaged with the bearings and the diffusers, the coupling pins at least partially securing each of the bearings to one of the diffusers to resist a rotational force applied to the bearings.

Some embodiments of the instant disclosure may relate to a method of assembling a centrifugal pump, the method including: forming a stack of a plurality of diffusers; housing a plurality of impellers in the plurality of diffusers; extending a rotational shaft through the plurality of impellers to impart rotation to the plurality of impellers; supporting the rotational shaft with a plurality of bearings positioned within the plurality of diffusers; and positioning coupling pins between the plurality of bearings and the plurality of diffusers to at least partially secure each of the plurality of bearings to restrict, limit, and/or minimize relative rotation between the plurality of bearings and the plurality of diffusers.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION

Figure 1:
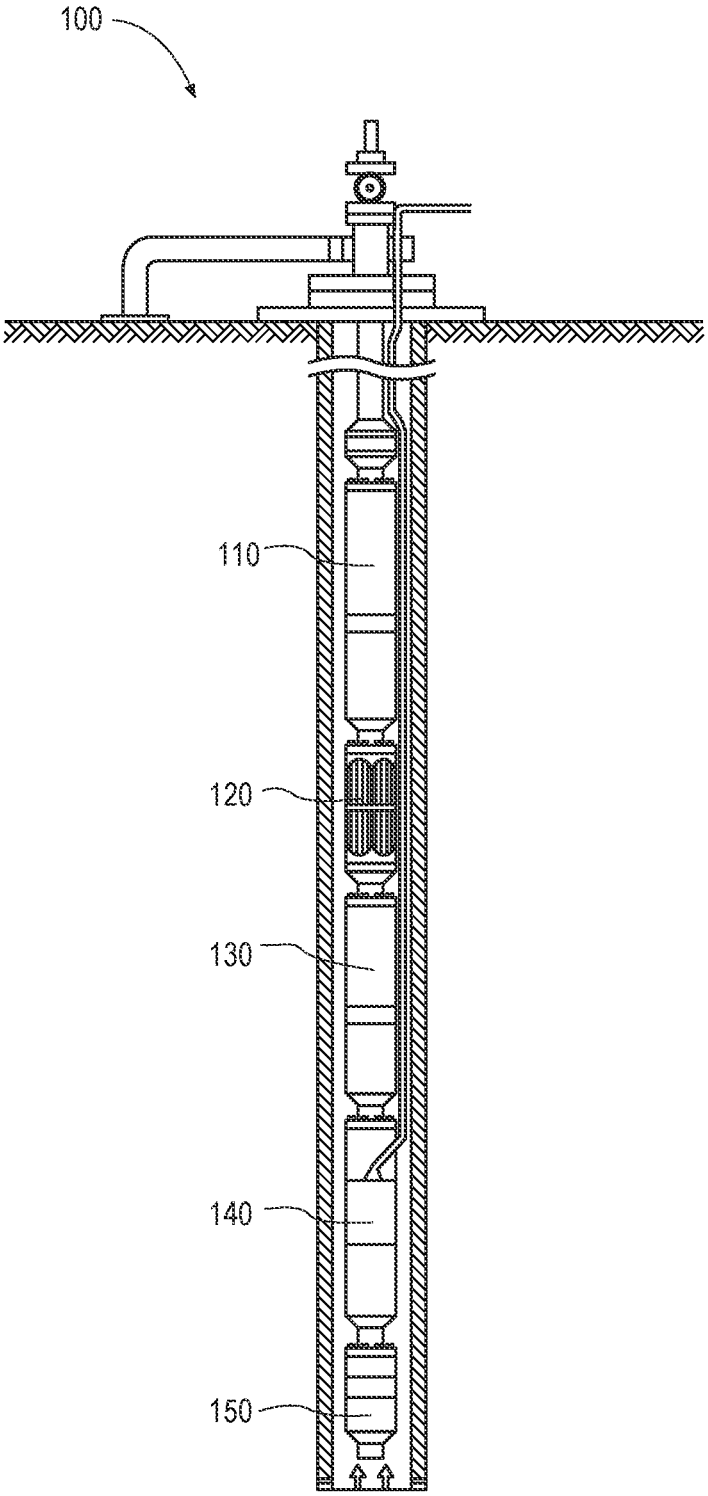
FIG. 1 is a simplified side or elevation view of a downhole centrifugal pump system according to an embodiment of the disclosure.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical," "lateral," "radial," "uphole," and "downhole" refer to the orientations as depicted in the figures.

Embodiments of the instant disclosure are directed to exemplary fluid handling devices (e.g., pumps) that include one or more locking features. Such locking features may act to at least partially maintain (e.g., substantially maintain, substantially prevent movement of) the position of one or more components of the fluid handling device.

For example, a pump (e.g., a submersible pump, an electric submersible pump (ESP), a centrifugal pump, a multistage centrifugal pump, or any suitable pump, without limitation) may include or be coupled to a motor that drives a shaft coupled to impellers which are, in turn, rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacent upper impeller, repeats until the fluid travels from the downhole source to an upper destination.

In such a configuration, the diffusers and the components of the diffuser (e.g., diffuser bearings) are intended to remain substantially (e.g., entirely) stationary relative to the impellers and the shaft that rotate within the diffusers. The diffusers include one or more components that are positioned adjacent to (e.g., in contact with) one or more of the rotating shaft or the impellers. For example, one or more wear components (e.g., diffuser bearings or bushings) may provide a support surface for the rotating shaft as the shaft and impellers are driven by a motor.

In some embodiments, such diffuser bearings may be coupled to respective diffusers using an interference fit. For example, the diffusers may be heated to expand the material forming a housing or body of the diffuser bearings and the bearing may be installed. Once cooled, the diffusers may form a relatively tight fit to hold the bearings in place and minimize relative movement between the diffuser and an associated bearing.

However, during use, the couplings or connections between diffusers and the bearings may begin to degrade, enabling movement (e.g., rotational movement) of the bearing relative to the diffusers due to the rotation of the shaft. Such movement of the diffuser bearings may be relatively more common in relatively high heat applications where deformation (e.g., expansion) of the diffusers may loosen the couplings between the diffusers and the bearings to enable relative movement between the diffusers and the bearings. In additional embodiments, manufacturing defects, wear, damage, and/or other defects may cause the bearings to begin rotating within the diffusers.

In accordance with some embodiments of the disclosure, one or more locking features (e.g., mechanical stops) may be implemented in such pumps to at least partially ensure that one or more components of the diffusers remain in a stationary configuration where the one or more components do not substantially move relative to the rotating impellers and shaft, which are rotated by a motor to operate the pump. For example, the one or more components of the diffusers including such locking features may be components that are directly adjacent to or in direct contact with one or more of the spinning shaft or the impellers coupled to the shaft. The locking features may resist (e.g., minimize, substantially prevent) these components (e.g., wear components, such as the bearings or bushings that support the shaft within the pump) from beginning to rotate with the shaft due to the rotational forces (e.g., torque) associated with the spinning shaft.

As discussed below, the locking features may include one or more pins positioned to extend between diffusers and bearings housed by the diffusers in order to resist or minimize (e.g., substantially prevent) rotational movement of the diffuser bearings.

In some embodiments, an additional locking feature (e.g., a bushing housed by the diffuser via an interference fit) may be used to resist movement of the component (e.g., the bearing) in another direction of movement (e.g., movement in an axial direction along the shaft).

In some embodiments, the material of such a bushing may be selected to be similar to the material of the diffuser such that expansion and/or contraction of the diffuser and bushing may occur in a similar manner and/or rate due to heating and/or cooling during operation of the pump (e.g., by providing similar coefficients of thermal expansion (CTEs)). In such a configuration, the collective expansion and contraction of the bushing and the diffuser together may render it less likely that the bushing becomes loose in the body of the diffuser that houses the bushing.

Such locking features may be of particular use in applications where the pump is implemented in high heat environments and/or where the fluid being pumped includes a relatively high amount of fluid that is in an at least partially gaseous state. Such an environment may include a relatively higher amount of gas intermittently flowing or flowing in a substantially constant stream through the pump. In embodiments where a submersible pump is implemented, the pump may at least partially lack a separate lubrication or working fluid. Such a pump configuration at least partially relies on the process fluid being supplied through the pump to cool one or more components of the pump. As a result, in a relatively high gas environment where adequate lubrication may be intermittent or relatively less reliable, the components of the pump may be subjected to periods of relatively high heating that increase the probability of the components of the diffusers, such as the bearings, becoming dislodged and beginning to move. Embodiments of the instant disclosure including one or more locking features may enable the reduction of efficiency and/or failure of the pump due to movement of the components of the diffusers even in such high gas applications.

As discussed below, in some embodiments, the components of the diffusers may be coupled using a nonthreaded coupling device, such as, for example, a pin (e.g., protrusion) that is received in (e.g., slidingly received in) one or more complementary recesses defined between the body of the diffusers and one or more components of the diffusers. The use of such nonthreaded pins or protrusions may enable relatively simplified manufacture, assembly, and/or disassembly of the diffuser stack and associated componentry.

It is noted that the use of such locking features is discussed below primarily in relation to connections between the body of a diffuser and a diffuser bearing that is held by the body of the diffuser in order to interact with the shaft and/or impellers. However, in additional embodiments, such locking features may be used with any suitable components of the pump to resist relative movement between two or more components of the pump during use.

FIG. 1 is a simplified side or elevation view of a downhole centrifugal pump system. Downhole centrifugal pump systems generally include at least a downhole structure housing a pump coupled to a motor. In some implementations, the downhole structure may include a plurality of pumps coupled to a plurality of motors. Depending on the use scenario, the downhole structure can be submerged in one or more fluid sources (e.g., oil or gas reservoir, aquifer, etc.) as needed. The plurality of pumps in the downhole structure may upwardly pump the fluid from the fluid source to receiving containers (e.g., tanks, vessels, etc.) at a higher elevation relative to the fluid source.

As shown in FIG. 1, the downhole centrifugal pump system 100 may include one or more pumps 110, one or more gas handling devices 120, one or more protector devices 130, one or more motors 140, and one or more monitoring devices 150.

Figure 2:
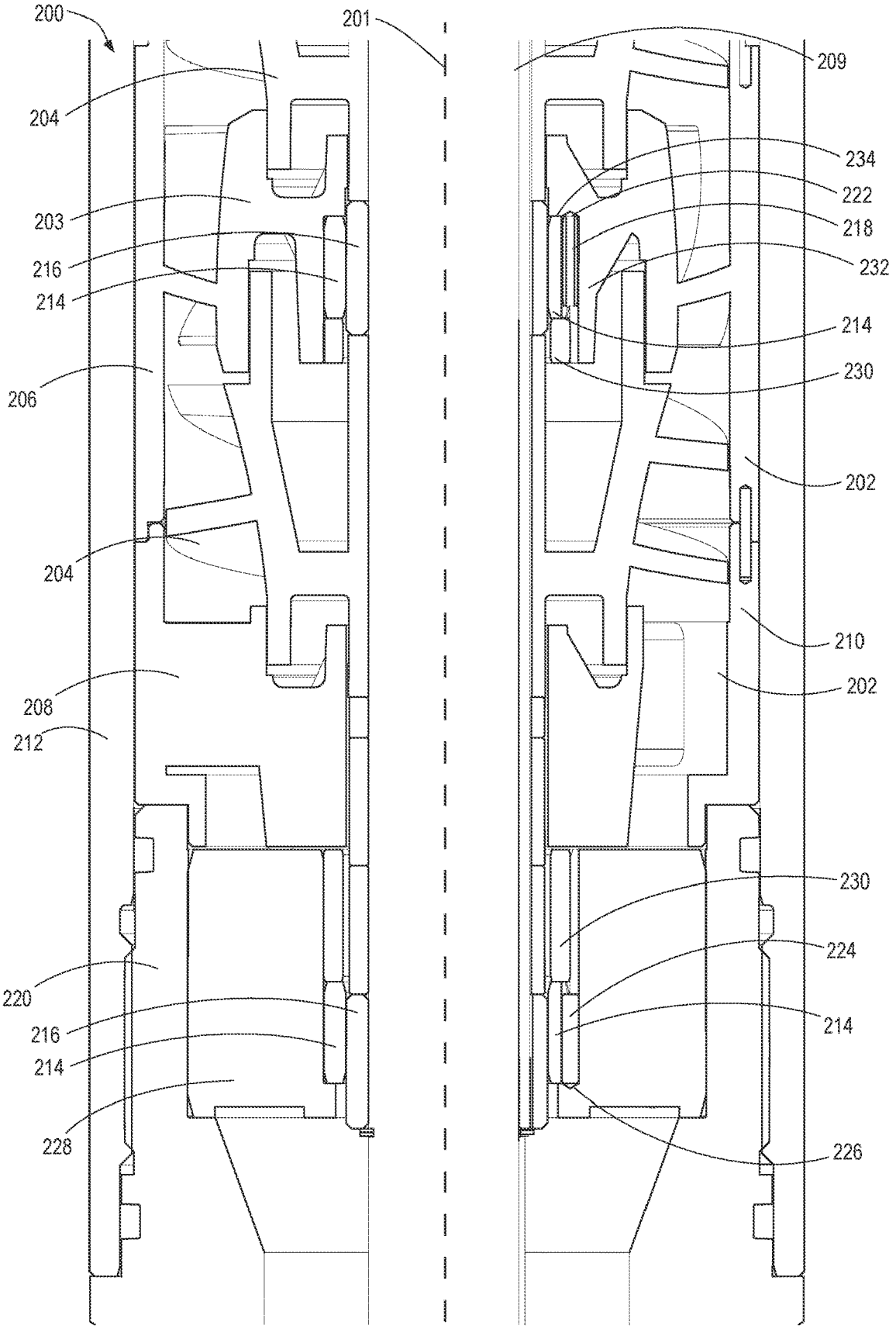
FIG. 2 is a cross-sectional view of a portion of a centrifugal pump according to an embodiment of the disclosure.

The pump 110 may include a series of impellers and diffusers that are alternatingly coupled to each other. For example, and as shown in FIG. 2, the series of impellers and diffusers of the pump 110 may include impellers 204 rotationally coupled to associated diffusers 202. As above, in some implementations, the pump 110 may be an electric submersible pump (ESP) configured to operate in high-volume wells and/or horizontal or highly deviated wells. For example, the pump 110 may facilitate fluid production from 150 barrels per day (BPD) to 10,000 BPD and may range in size from 2 inches to more than 7 inches (5.08 to 17.78 centimeters) in diameter (e.g., 4 inches (10.16 centimeters)). This wide specification range allows the pump 110 to be adaptable to varying drilling conditions. Additionally, the pump 110 may be abrasion-resistant and may enable the ability to handle solids in, for example, high sand production scenarios.

Turning back to FIG. 1, the gas handling device 120 may be configured to mitigate against gas locking by reducing gas interference in the pump 110. In some implementations, the gas handling device 120 may incorporate rotary and vortex gas separators that enhance pump efficiency by preventing free gas from entering the pump 110 in the first place. Operations executed by the gas handling device 120 maximize fluid production by lowering pump drawdown and facilitating well uptime.

The protector device 130 may be configured to ensure electrical and mechanical integrity of the motor 140. The motor 140 (e.g., an electric motor, a hydraulic motor, an internal combustion engine, another type of prime mover, etc.) may operate the pump 110 by rotating one or more shafts that run through the length of pump 110 and that are coupled to impellers disposed in respective diffusers of the pump 110.

In some implementations, the protector device 130 may act as an oil reservoir that facilitates the expansion capacity of the motor 140. The protector device 130 may include a secure seal that keeps the motor 140 running smoothly. Additionally, the protector device 130 may further include one or more chambers adapted to prevent wellbore fluid contamination of the motor 140 by creating a low-pressure boundary between the well fluid and the clean oil used to lubricate the motor 140. Moreover, the protector device 130 may facilitate: torque transfer from the motor shaft to the gas handling device 120 and/or pump intake shaft; reinforcement of the pump shaft; and adaptation of the downhole centrifugal pump system 100 to specific implementation considerations.

The motor 140 may be configured to drive a shaft coupled to the pump 110 of the downhole centrifugal pump system 100. In some embodiments, the motor 140 may be an electric submersible motor configured for variable-speed operations, high temperature tolerance, and deep well pumping. The motor 140 may include one or more circuitry that allows 3-phase operations, 2-pole inductions, etc. The motor 140 may be fabricated using corrosion resistant materials such as stainless steel.

The monitoring device 150 may include software and/or firmware and other hardware that enables monitoring of the downhole centrifugal pump system 100. In some embodiments, the monitoring device 150 may include one or more sensors (e.g., temperature sensors, pressure sensors, etc.) that capture a plurality of information during the operation of the downhole centrifugal pump system 100. This information may be transmitted via a wired and/or wireless channel to user interfaces that facilitate viewing of monitoring data associated with various operations of the downhole centrifugal pump system 100 and/or conditions in which the downhole centrifugal pump system 100 operates.

FIG. 2 is a cross-sectional view of a portion of a centrifugal pump 200 having a longitudinal axis 201. As shown in FIG. 2, the centrifugal pump 200 may include a stack of diffusers 202 with impellers 204 positioned in the stack of diffusers 202. For clarity, only two diffusers 202 are shown (e.g., a middle diffuser 206 and an end diffuser 208) positioned adjacent to (e.g., coupled with) a pump base 220. However, any number of diffusers 202 may be implemented with the diffusers 202, for example, with a repeated stack of middle diffusers 206 extending to another end (e.g., an upper outlet) of the centrifugal pump 200.

As discussed above, the centrifugal pump 200 may include or be coupled to a motor that drives (e.g., rotates) a shaft 209. The shaft 209 is coupled to the impellers 204 in order to rotate the impellers 204 within the diffusers 202. Rotation of the impellers 204 within the diffusers 202 acts to drive fluid through the centrifugal pump 200. For example, in a downhole application, the impellers 204 drive the fluid from a lowermost or downhole portion of the centrifugal pump 200 where the fluid is supplied through an inlet to a fluid outlet at an uppermost or uphole portion of the centrifugal pump 200. In a downhole application, such a configuration may assist in moving the fluid up through the borehole to a location more proximate to a surface of the well.

Each of the diffusers 202 may include an outer portion (e.g., radial sidewall 210) that collectively defines an outer circumference of the stack of diffusers 202. The diffusers 202 may be received within an outer housing 212 of the centrifugal pump 200.

Each of the diffusers 202 and/or the pump base 220 may include one or more wear components (e.g., bearings 214) that interact with (e.g., support, provide a bearing surface for) the shaft 209 (e.g., via a spacer sleeve 216 of the shaft 209). For example, the shaft 209 may include one or more spacing sleeves 216 positioned between the impellers 204 that are secured to the shaft 209. Similar spacing sleeves 216 may be implemented at the downhole portion of the shaft 209 that extends through the pump base 220.

One or more pins 218 may be received within openings 222 defined between a body 203 of the diffusers 202 and the bearings 214. Similarly, one or more pins 224 may be received within an opening 226 defined between a portion of the pump base 220 (e.g., an insert 228) and a bearing 214 housed by the pump base 220.

In some embodiments, the pins 218 may be formed as a slotted pin to provide a biasing effect to the pins 218 as is shown in relative to the pin 218 in the diffuser 202. For example, the pins 218 may be compressed during assembly and then enabled to expand within the openings 222 to secure the pins 218. In some embodiments, the pins 224 may be a solid cylindrical structure as is shown in relation to the pin 224 in the pump base 220. In additional embodiments, the pins 218, 224 may be selected to all be one type of structure (e.g., slotted, hollow, or solid) or may vary in construction as desired based on the components being secured and location of such components.

As depicted, the pins 218, 224 may be a structure separate from the diffusers 202, the bearings 214, and/or the pump base 220. However, in additional embodiments, such as that discussed below, the pins 218, 224 may be an integral protrusion of any suitable shape that is formed with the diffusers 202, the bearings 214, and/or the pump base 220 and may be received in (e.g., secured in) a complementary opening (e.g., recess, hole, depression) of an adjacent component of the centrifugal pump 200. Further, the pins 218, 224 may be of any suitable shape, whether integrated or separate, in order to secure the bearings 214. For example, the pins 218, 224 may be substantially cylindrical (e.g., as depicted), cuboid, or any other polygonal or suitable shape.

Where separable or removable pins 218, 224 are implemented, each of the diffusers 202 or the insert 228 of the pump base 220 and a respective bearing 214 may include recesses to define the openings 222, 226. For example, axially extending recesses on each of the diffusers 202 or the insert 228 of the pump base 220 and the respective bearing 214 may collectively define the opening 222, 226 for receiving the separable pin 218, 224.

In some embodiments, only one pin 218, 224 or other protrusions may be implemented to secure each of the bearings 214. In additional embodiments, multiple pins 218, 224 or other protrusions may be implemented to secure each of the bearings 214.

In some embodiments, an additional locking feature (e.g., retaining bushings 230) may be used to further secure the bearings 214. For example, while the bearings 214 are secured within the body 203 of the diffusers 202 or the insert 228 of the pump base 220 in radial directions and retained against rotational forces (e.g., torque) by the pins 218, 224, the retaining bushings 230 may act to secure the bearings 214 in an axial direction (e.g., along longitudinal axis 201, along the shaft 209).

As depicted, the retaining bushings 230 may be positioned within the body 203 of the diffusers 202 or the insert 228 of the pump base 220 adjacent the bearings 214 to secure the bearings 214 against on one axial side while another portion of the body 203 of the diffusers 202 or the insert 228 of the pump base 220 secures the bearings 214 on the other axial side. In some embodiments, the retaining bushings 230 may be positioned downhole of the bearings 214 (e.g., as in the body 203 of the diffuser 202) or uphole of the bearings 214 (e.g., as in the insert 228 of the pump base 220).

In some embodiments, the retaining bushings 230 may be secured in the body 203 of the diffusers 202 or the insert 228 of the pump base 220 with an interference fit similar to that discussed above where heating is used to expand the component that is to receive the retaining bushing 230.

As noted above, in some embodiments, the materials of the components of the pump 200 and one or more of the locking features may be selected to provide a similar expansion and/or contraction during heating and cooling periods within the pump 200. For example, the diffusers 202 and/or pump base 220 and the retaining bushings 230 may be selected to have a similar (e.g., substantially the same) coefficient of thermal expansion (CTE). In some embodiments, the diffusers 202 and/or pump base 220 and the retaining bushings 230 may each be formed from a metallic material (e.g., a ductile iron) in order to exhibit a similar CTE.

In some embodiments, the bearings 214 may be formed from a differing material that is more suitable for the wear surfaces required to handle the rotational forces of the shaft 209 and impellers 204. For example, the bearings 214 or wear surfaces of the bearings 214 may comprise a metallic material (e.g., carbon steel, titanium or titanium alloys, tungsten or tungsten alloys, aluminum or aluminum alloys, or stainless steel, etc.), a carbide material (e.g., tungsten carbide, silicon carbide, etc.), a polycrystalline diamond (PCD) material, or any other suitable material.

Figure 3:
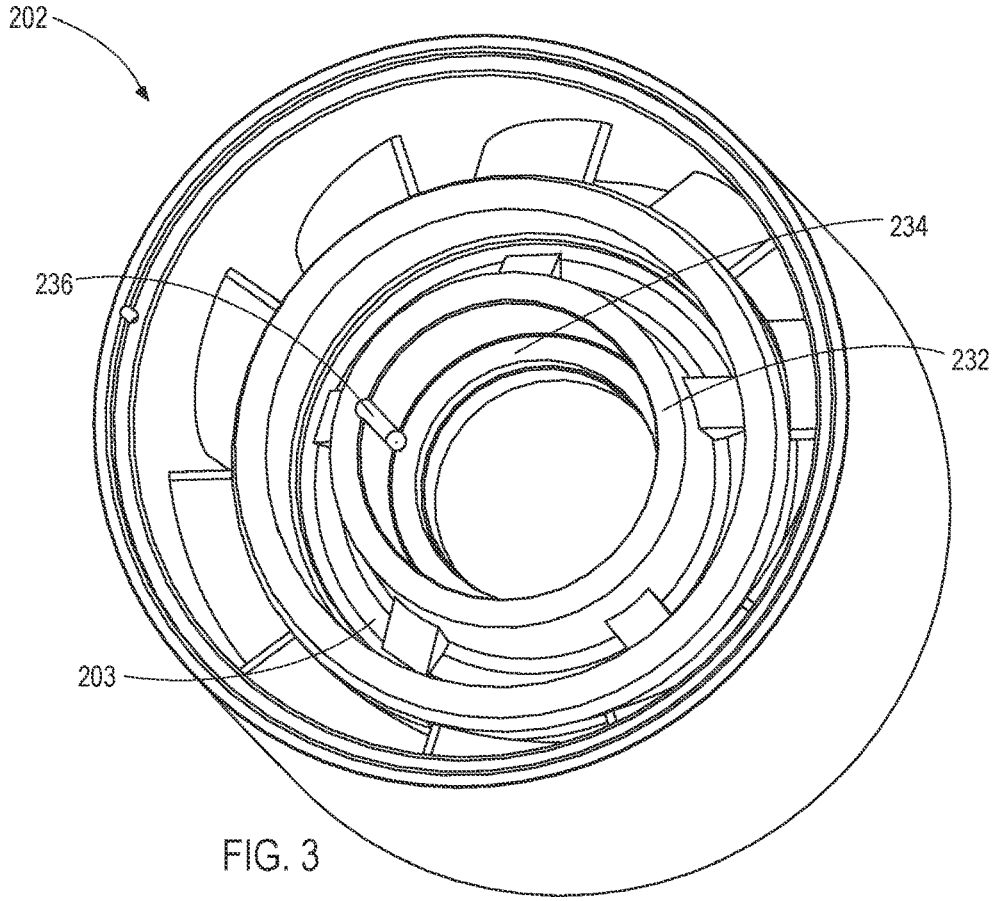
FIG. 3 is a perspective view of a diffuser of a centrifugal pump according to an embodiment of the disclosure.

FIG. 3 is a perspective view of a diffuser of a centrifugal pump, which, in some embodiments, may be similar to the diffusers 202 of the centrifugal pump 200 discussed above. It is noted that the inner portion of the insert 228 of the pump base 220 may include similar structures for housing an associated bearing 214.

Figure 4:
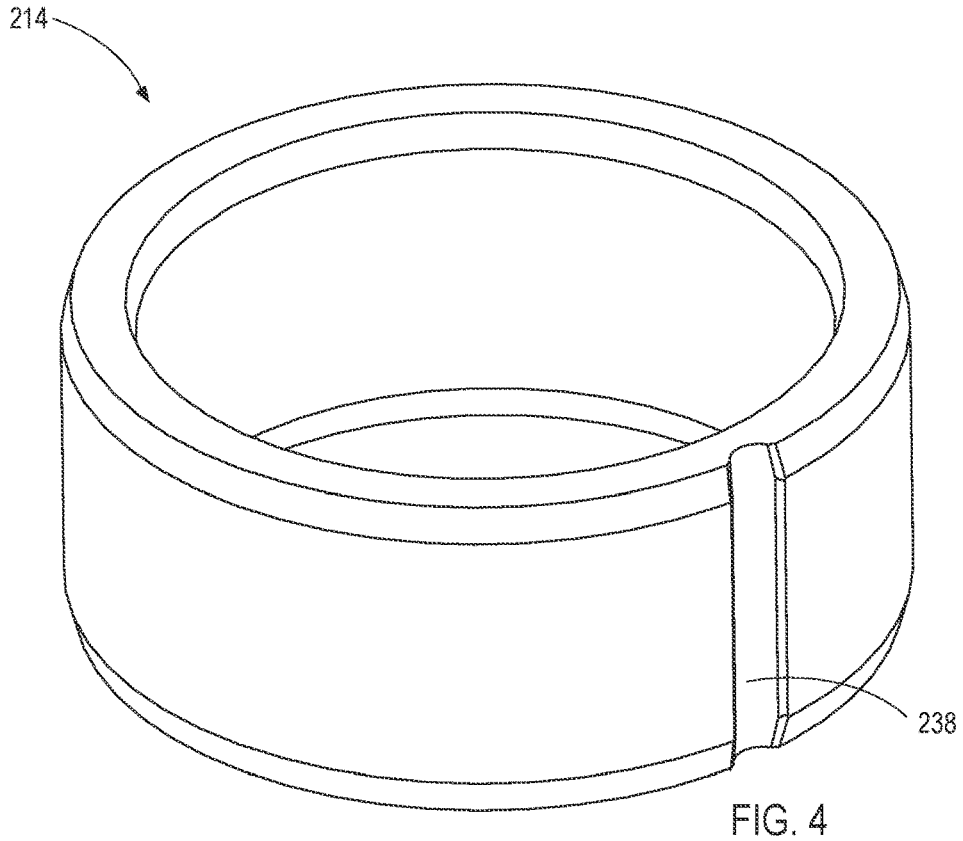
FIG. 4 is a perspective view of a bearing of a centrifugal pump according to an embodiment of the disclosure.

FIG. 4 is a perspective view of a bearing of a centrifugal pump which, in some embodiments, may be similar to the bearings 214 of the centrifugal pump 200 discussed above.

As shown in FIGS. 3 and 4, the body 203 of the diffusers 202 may include a central annular portion 232 defining a recess for receiving an associated bearing 214 and the shaft 209 (FIG. 2). The annular portion 232 may be positioned at an innermost radial portion of the diffuser 202. The annular portion 232 may include a shelf 234 at one axial end for abutting with the bearing 214 when the bearing 214 is positioned in the recess defined by the annular portion 232.

A sidewall of the body 203 at the annular portion 232 may include a recess 236 (e.g., an indentation) on an inner diameter (e.g., an interior diameter) of the body 203 of the diffuser 202 that defines at least part of the opening 222 for receiving the pin 218. For example, the recess 236 may extend in an axial direction along the annular portion 232 to receive approximately half of the pin 218 when the pin 218 is inserted between the bearing 214 and the diffuser 202. As depicted, the recess 236 may extend to and stop at the shelf 234 to provide a stop for one axial end of the pin 218, 224 (FIG. 2).

The bearing 214 may include a similar recess 238 defined in a sidewall of the bearing 214 on an outer or exterior diameter or circumference of the bearing 214. For example, the recess 238 may extend in an axial direction along the bearing 214 to receive approximately the other half of the pin 218 when the pin 218 is inserted between the bearing 214 and the diffuser 202.

In additional embodiments, other configurations and shapes of the recesses 236, 238 along with the configuration and shape of the pin 218 may be implemented.

Figure 5:
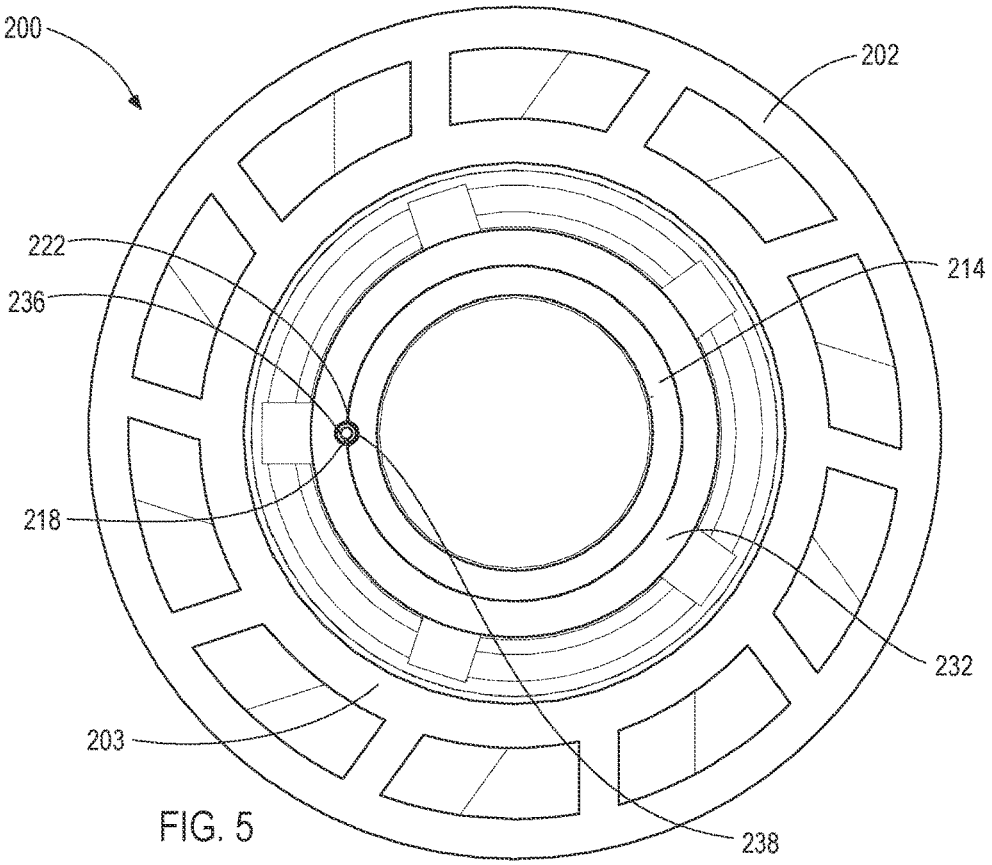
FIG. 5 is a cross-sectional view of a portion of a centrifugal pump including a bearing in a diffuser according to an embodiment of the disclosure.

FIG. 5 is a cross-sectional view of a portion of a centrifugal pump including a bearing received in a diffuser, which, in some embodiments, may be similar to the bearings 214 and the diffusers 202 of the centrifugal pump 200 discussed above. As shown in FIG. 5, the bearing 214 is situated in the annular portion 232 of the body 203 of the diffuser 202. The pin 218 is received in between the recesses 236, 238 that define the opening 222 in order to rotationally secure the bearing 214 in the body 203 of the diffuser 202.

Figure 6:
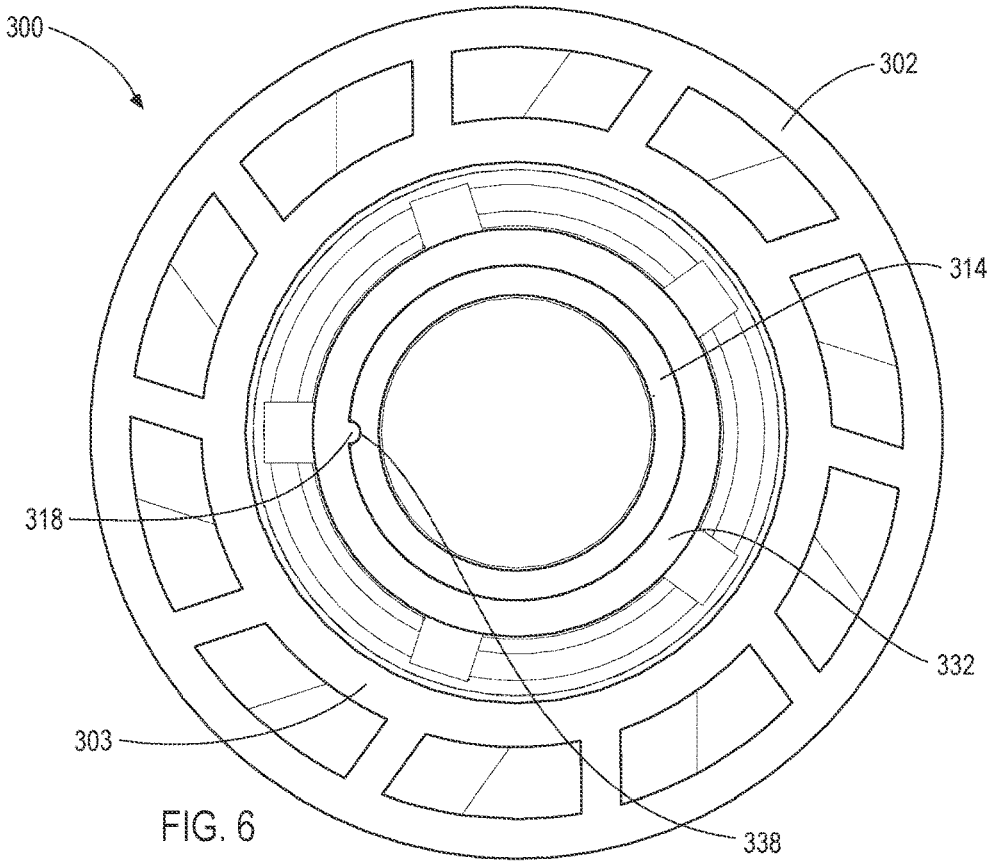
FIG. 6 is a cross-sectional view of a portion of a centrifugal pump including a bearing in a diffuser according to an embodiment of the disclosure.

FIG. 6 is a cross-sectional view of a portion of a centrifugal pump 300, which, in some embodiments, may be similar to and include one or more components of the centrifugal pump 200 discussed above. As shown in FIG. 6, the centrifugal pump 300 may include a bearing 314 situated in an annular portion 332 of a body 303 of a diffuser 302. As discussed above, the pin 318 may be an integral protrusion of any suitable shape that is formed with the diffuser 302 and may be received in a recess 338 in the bearing 314 in order to rotationally secure the bearing 314 in the body 303 of the diffuser 302. In some embodiments, the pin 318 and the diffuser 302 may define a monolithic structure.

As depicted, the pin 318 may be defined as a partially cylindrical protrusion (e.g., a half cylinder, a cylindrical segment, a truncated cylinder, etc.) extending radially outward from an outer sidewall of the diffuser 302. The pin 318 may be received in the recess 338 of the bearing 314 that is complementary to the pin 318 of the diffuser 302.

Figure 7:
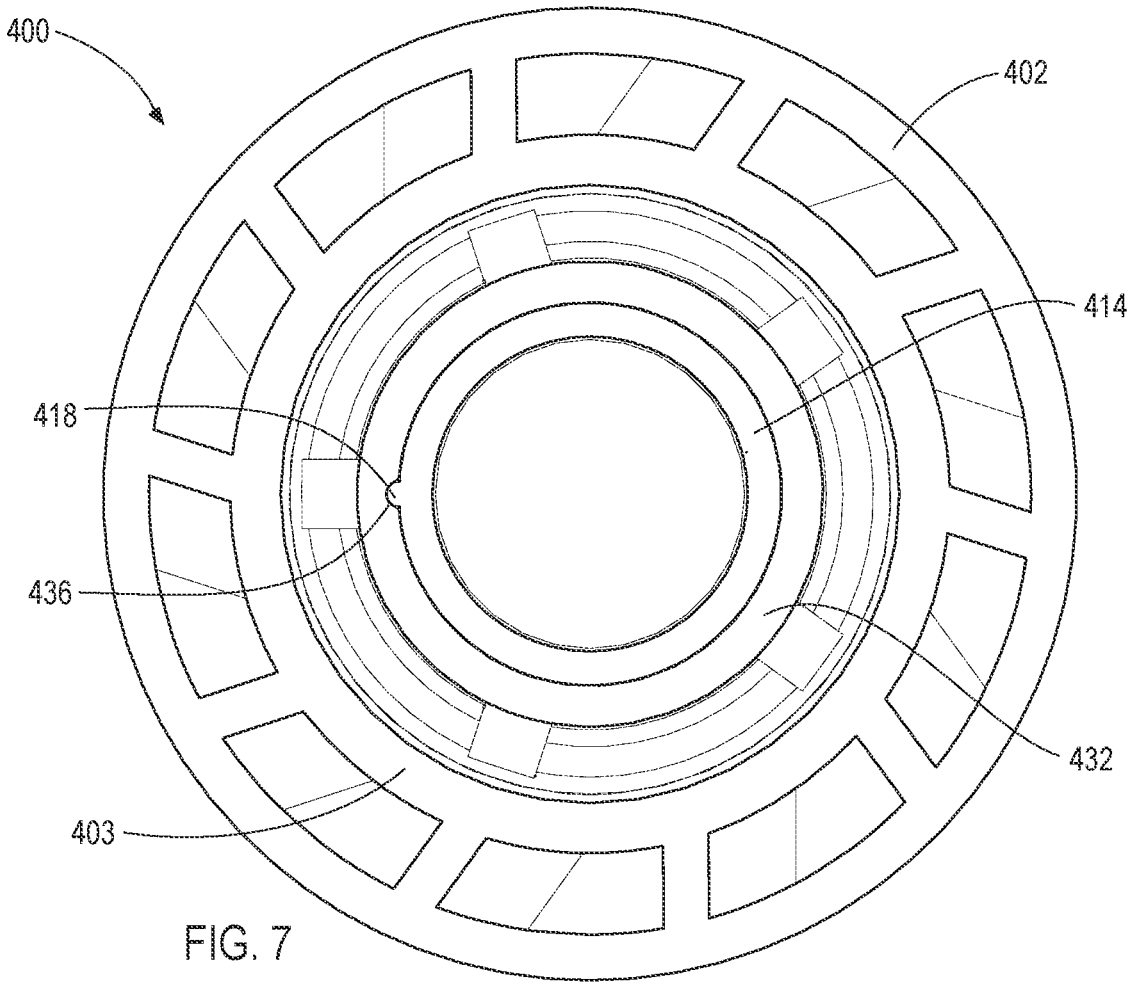
FIG. 7 is a cross-sectional view of a portion of a centrifugal pump including a bearing in a diffuser according to an embodiment of the disclosure.

FIG. 7 is a cross-sectional view of a portion of a centrifugal pump 400, which, in some embodiments, may be similar to and include one or more components of the centrifugal pump 200 discussed above. As shown in FIG. 7, the centrifugal pump 400 may include a bearing 414 situated in an annular portion 432 of a body 403 of a diffuser 402. As discussed above, the pin 418 may be an integral protrusion of any suitable shape that is formed with the bearing 414 and may be received in a recess 436 in the annular portion 432 of the diffuser 402 in order to rotationally secure the bearing 414 in the body 403 of the diffuser 402. In some embodiments, the pin 418 and the bearing 414 may define a monolithic structure.

As depicted, the pin 418 may be defined as a partially cylindrical protrusion (e.g., a half cylinder, a cylindrical segment, a truncated cylinder, etc.) extending radially outward from an outer sidewall of the bearing 414. The pin 418 may be received in the recess 436 of the diffuser 402 that is complementary to the pin 418 of the bearing 414.

Embodiments of the disclosure may include methods of assembling or reassembling a pump with stages of diffusers and impellers (e.g., centrifugal pump such as that discussed above). Referring to FIGS. 2 through 7, such a method may include housing the impellers 204 in the diffusers 202, 302, 402 where the impellers 204 are mounted on the rotational shaft 209 passing through the impellers 204 to impart rotation to the impellers 204. A stack of the diffusers 202, 302, 402 may be defined or formed by positioning radial sidewalls 210 of the diffusers 202, 302, 402 adjacent to each other.

Bearings 214, 314, 414 may be secured within the pump 200, 300, 400 (e.g., within the diffusers 202, 302, 402, and/or the pump base 220) with one or more coupling pins 218, 224, 318, 418. The coupling pins 218, 224, 318, 418 may be positioned between the diffusers 202, 302, 402 and/or the pump base 220 and the bearings 214, 314, 414 to at least partially secure each of the bearings 214, 314, 414 to minimize (e.g., substantially prevent) relative rotation between the diffusers 202, 302, 402 and/or the pump base 220 and the respective bearings 214, 314, 414 positioned therein.

Terms of degree (e.g., "about," "substantially," "generally," etc.) indicate structurally or functionally insignificant variations. In an example, when the term of degree is included with a term indicating quantity, the term of degree is interpreted to mean±10%, +5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, et cetera.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. Further, the words "including," "having," and variants thereof (e.g., "includes" and "has") as used herein, including the claims, shall be open-ended and have the same meaning as the word "comprising" and variants thereof (e.g., "comprise" and "comprises"). In addition, features from one embodiment may be combined with features of another embodiment while still being encompassed within the scope of the disclosure as contemplated by the inventors.

What is claimed is:

1. A downhole centrifugal pump comprising:

impellers;

a rotational shaft passing through the impellers to impart rotation to the impellers;

diffusers having a body housing the impellers;

bearings positioned within at least some of the diffusers, the bearings being positioned within a central portion of the body of each of the at least some of the diffusers with the rotational shaft extending through each of the bearings to support the rotational shaft during the rotation of the impellers;

coupling pins positioned between and engaged with the bearings and the at least some of the diffusers, the coupling pins configured to at least partially secure each of the bearings to one of the at least some of the diffusers against a rotational force applied to the bearings from the rotation of the rotational shaft; and bushings positioned adjacent to the bearings, the bushings each configured to secure one of the bearings along the rotational shaft in the central portion of the body of the at least some of the diffusers, wherein the bushings are each coupled to the central portion of the body of the at least some of the diffusers with an interference fit to substantially prevent the bearings from moving in an axial direction along the rotational shaft.

2. The downhole centrifugal pump of claim 1, wherein at least one of the bearings is coupled to another component of the downhole centrifugal pump with at least one of the coupling pins.

3. The downhole centrifugal pump of claim 2, wherein the another component of the downhole centrifugal pump comprises a pump base coupled to an end diffuser of the diffusers.

4. The downhole centrifugal pump of claim 1, wherein the coupling pins each comprise a biasing feature for securing the coupling pins between the bearings and the at least some of the diffusers.

5. The downhole centrifugal pump of claim 1, wherein a material of the bushings is selected to exhibit a coefficient of thermal expansion (CTE) that is the same as a coefficient of thermal expansion (CTE) of a material of the diffusers.

6. The downhole centrifugal pump of claim 1, wherein the coupling pins each comprise a separable nonthreaded pin being removable from each of the at least some of the diffusers.

7. The downhole centrifugal pump of claim 6, wherein the separable nonthreaded pin comprises a slotted pin or a solid cylindrical pin.

8. The downhole centrifugal pump of claim 1, wherein the coupling pins each comprise a protrusion extending from an outer sidewall of the bearings.

9. The downhole centrifugal pump of claim 1, wherein the coupling pins each comprise a protrusion extending from an inner sidewall of the central portion of the body of the at least some of the diffusers.

10. The downhole centrifugal pump of claim 1, wherein each of the bearings is secured in a first axial direction by directly abutting a shelf defined by the body of the at least some of the diffuser in the central portion of the body of the at least some of the diffusers and secured in a second, opposing axial direction by a bushing of the bushings.

11. A centrifugal pump comprising:

impellers;

a rotational shaft passing through the impellers to impart rotation to the impellers;

diffusers having a body housing the impellers;

bearings positioned within the diffusers to support the rotational shaft extending through each of the bearings during the rotation of the impellers, wherein each of the bearings is secured in an axial direction by directly abutting a shelf defined by the diffusers in a central portion of the diffusers, the shelf configured to prevent axial movement of the bearings relative to one of the diffusers in an axial direction; and coupling pins positioned between and engaged with the bearings and the diffusers, the coupling pins at least partially securing each of the bearings to one of the diffusers to resist a rotational force applied to the bearings.

12. The centrifugal pump of claim 11, further comprising bushings positioned adjacent to the bearings, the bushings each configured to prevent axial movement of one of the bearings relative to one of the diffusers in a second axial direction that is opposite to the axial direction.

13. The centrifugal pump of claim 11, wherein each of the coupling pins is received between a first recess defined in each of the bearings and a second recess formed in each of the diffusers.

14. The centrifugal pump of claim 11, wherein the coupling pins are formed as an integral structure of the bearings.

15. The centrifugal pump of claim 11, wherein the coupling pins are formed as an integral structure of the diffusers.

16. A method of assembling the centrifugal pump of claim 11, the method comprising:

forming a stack of the diffusers;

housing the impellers in the diffusers;

extending the rotational shaft through the impellers to impart rotation to the impellers;

supporting the rotational shaft with the bearings positioned within the diffusers; and positioning the coupling pins between the bearings and the diffusers to at least partially secure each of the bearings to restrict relative rotation between the bearings and the diffusers.

17. A centrifugal pump comprising:

impellers;

a rotational shaft passing through the impellers to impart rotation to the impellers;

diffusers having a body housing the impellers;

bearings positioned within the diffusers to support the rotational shaft extending through each of the bearings during the rotation of the impellers;

coupling pins engaged with the bearings and the diffusers, the coupling pins at least partially securing each of the bearings to one of the diffusers to resist a rotational force applied to the bearings; and bushings secured within the diffusors at a location axially adjacent to the bearings to secure one of the bearings along the rotational shaft, the bushings configured to prevent axial movement of the bearings relative to the diffusers in an axial direction.

18. The centrifugal pump of claim 17, wherein the bushings are each coupled to a central portion of a respective one of the diffusers with an interference fit.

19. The centrifugal pump of claim 18, wherein a coefficient of thermal expansion (CTE) of the bushings is the same as a coefficient of thermal expansion (CTE) of the diffusers.

20. The centrifugal pump of claim 17, wherein each of the bearings is secured in a first axial direction by directly abutting a shelf defined in a central portion of the diffusers and secured in a second, opposing axial direction by a bushing of the bushings.

* * * * *